US012741681B2

(12) United States Patent
Strössner et al.

(10) Patent No.: US 12,741,681 B2
(45) Date of Patent: Sep. 22, 2026

(54) METHOD FOR CARRYING OUT AN EMERGENCY STOP FOR A TRAIN

(71) Applicant: Siemens Mobility GmbH, Munich (DE)

(72) Inventors: Christian Strössner, Grossenseebach (DE); Georg Lohneis, Ebensfeld (DE)

(73) Assignee: Siemens Mobility GmbH, Munich (DE)

( * ) Notice: Subject to any disclaimer, the term of this patent is extended or adjusted under 35 U.S.C. 154(b) by 57 days.

(21) Appl. No.: 18/994,747

(22) PCT Filed: Jul. 7, 2023

(86) PCT No.: PCT/EP2023/068826
§ 371 (c)(1),
(2) Date: Jan. 15, 2025

(87) PCT Pub. No.: WO2024/013008
PCT Pub. Date: Jan. 18, 2024

(65) Prior Publication Data

US 2026/0015018 A1 Jan. 15, 2026

(30) Foreign Application Priority Data

Jul. 15, 2022 (DE) ..... 10 2022 207 259.6

(51) Int. Cl.
*B61L 23/00* (2006.01)
*B61L 15/00* (2006.01)
(Continued)

(52) U.S. Cl.
CPC ..... *B61L 15/0062* (2024.01); *B61L 15/0072* (2013.01); *B61L 15/0094* (2024.01);
(Continued)

(58) Field of Classification Search
CPC ..... B61L 23/00; B61L 27/00; B61L 27/04; B61L 27/16; B61L 27/20; B61L 27/70
(Continued)

(56) References Cited

U.S. PATENT DOCUMENTS 4,988,061 A 1/1991 Miller et al.
12,441,362 B2 * 10/2025 Gawne ..... G01C 21/3407
(Continued)

FOREIGN PATENT DOCUMENTS

CN 114454924 A 5/2022
DE 3807919 A1 9/1989
(Continued)

*Primary Examiner* — Erick R Solis
(74) *Attorney, Agent, or Firm* — Laurence A. Greenberg; Werner H. Stemer; Ralph E. Locher

(57) ABSTRACT

A method carries out a requested emergency stop for a train in order to bring the train to a stop at a suitable point on the route travelled by the train. On the train side, a list is provided in which, for the route to be travelled by the train, zones are defined where the train is allowed to stop and/or is not allowed to stop in the event of a requested emergency stop. When the train is travelling, a request for an emergency stop is automatically recorded and analyzed by the train without the involvement of the driver. The train carries out an automated determination of the position of the train in relation to the route being travelled, which is carried out independently of route-side apparatuses. Depending on the position of the train, a suitable zone where the train can be brought to a standstill for the emergency stop to be carried out is automatically selected from the list.

10 Claims, 2 Drawing Sheets

(51) Int. Cl.

| | |
|---|---|
| ***B61L 27/04*** | (2006.01) |
| ***B61L 27/16*** | (2022.01) |
| ***B61L 27/20*** | (2022.01) |
| ***B61L 27/70*** | (2022.01) |

(52) U.S. Cl.
CPC ..... *B61L 23/00* (2013.01); *B61L 27/04* (2013.01); *B61L 27/16* (2022.01); *B61L 27/70* (2022.01)

(58) Field of Classification Search
USPC ..... 701/19, 20
See application file for complete search history.

(56) References Cited

U.S. PATENT DOCUMENTS

| | | | | |
|---|---|---|---|---|
| 2024/0051587 | A1* | 2/2024 | Liu | B61L 27/40 |
| 2026/0070593 | A1* | 3/2026 | Strössner | B61L 15/0081 |

FOREIGN PATENT DOCUMENTS

| | | | |
|---|---|---|---|
| JP | 2014193098 | A | 10/2014 |
| JP | 2021119067 | A | 8/2021 |

* cited by examiner

METHOD FOR CARRYING OUT AN EMERGENCY STOP FOR A TRAIN

FIELD AND BACKGROUND OF THE INVENTION

The invention relates to a method for carrying out a requested emergency stop for a train, so that the train comes to a stop at a suitable point on the route traveled by the train.

The term "train" is used here to refer to a combination of several rail vehicles or a single rail vehicle.

In rail operations, it is necessary in an emergency situation to bring a train to a stop, known as an "emergency stop", as quickly as possible.

It is known to request an emergency stop from the train driver, for example

- by a request triggered by a passenger. This request is made, for example, by the passenger in a passenger coach actuating a lever designated as an "EMERGENCY BRAKE" in order to trigger the request.
- by a request triggered by a rail vehicle's internal control system. This request is made, for example, in response to a technical fault detected on the rail vehicle.

In both cases, it is the driver's responsibility to assess the emergency stop request depending on the situation and to react appropriately.

Accordingly, the train driver initiates the emergency stop, cancels an already automatically triggered braking if necessary, or ignores the request—for example in the event of a recognizable misuse of the "emergency brake" lever or a recognizable control system error.

A suitable location for the emergency stop is selected by the train driver who, depending on the situation, selects a suitable location for the emergency stop on the route and brings the rail vehicle to a stop there.

The emergency stop is not allowed take place at any point on the route traveled by the rail vehicle; for example, it is not permissible or is unfavorable on a bridge or in a tunnel due to safety requirements and access restrictions.

Depending on the hazardous situation, reaction time and situation overview, this involvement of the train driver can lead to an unsuitable or poorly suitable location for the emergency stop of the train.

SUMMARY OF THE INVENTION

A method for determining the optimal stopping of a railway train is known from the publication JP 2014193098 A. In this method, an optimal stop position is determined taking into account risks (such as an impact with an obstacle or a derailment).

It is therefore the object of the present invention to provide an improved method for stopping a train at a suitable point in the event of an emergency stop.

This object is achieved by the features of the independent method claim. Advantageous further embodiments are given in the dependent claims.

The invention relates to a method for carrying out a requested emergency stop for a train in order to bring the train to a stop at a suitable point on the route traveled by the train.

In a first step, before the train starts its journey, the route it is to travel is analyzed with regard to suitable stopping points or stopping zones that are suitable for stopping the train in the event of an emergency stop. These points are defined as emergency stop zones Alternatively or in addition to this, so-called "emergency stop prevention zones" are defined in which the train is not allowed to stop in the event of an emergency stop.

The emergency stop prevention zones include, for example, bridges, tunnels, areas of track that are difficult to access, etc.

The respective zones are preferably defined with the aid of a high-precision electronic geographical map in order to precisely define the zones (emergency stop zones and/or emergency stop prevention zones) by means of geographical coordinates or position information.

The zones are saved or stored as a list on board the train for automated use before the start of the journey.

The list is preferably stored in the train's vehicle control system and is therefore available on the train side.

Preferably, only the emergency stop prevention zones are stored in the list on board the train; accordingly, remaining sections of track are considered suitable emergency stop zones that can be used for this purpose.

The list is thus shortened and can be queried quickly and automatically, so that the method according to the invention can be carried out quickly.

In a second step, a request for an emergency stop is recorded and analyzed by the train without the involvement of the driver.

The request is preferably received, evaluated and processed by an automatic emergency stop function provided for this purpose.

As described above, the request for an emergency stop is triggered, for example, by a passenger or by a train or rail vehicle's internal control system.

In a preferred development, the emergency stop request is optionally communicated to the train driver. The train driver then has the option of "resetting" the request for an emergency stop or manually postponing the execution of the emergency stop or suppressing it altogether depending on the situation.

In accordance with the invention, a fixed operations control center referred to as being "land-side" is automatically notified of the request for an emergency stop.

This automated notification is preferably carried out with the aid of the emergency stop function, which automatically generates corresponding information when the request for an emergency stop is received and transmits it to the operations control center.

In a preferred development, as part of the information

- a cause of the requested emergency stop (e.g., message "Fire on board" or "Emergency brake lever actuated", etc.) is transmitted, and/or
- a geographical location where the emergency stop request was triggered is transmitted, and/or
- a geographical location is transmitted at which the train will probably come to a standstill if technical damage is detected,
- information about a train section (carriage) in which the request for an emergency stop was triggered by a passenger is transmitted.

The automated notification makes it possible to initiate a rescue chain on land, take appropriate measures to deal with the emergency stop of the train, subsequently analyze the emergency stop and/or notify maintenance staff, etc.

In a preferred development, the automated notification of the land side is carried out via a secure and highly available data connection, which in particular fulfills a necessary safety level in accordance with the European standard EN 50128 or EN 50657 and EN 50159.

In a third step, the position of the train is automatically determined.

The position is preferably determined on the train side and therefore independently of the land side. This enables accelerated and autonomous processing of the method according to the invention.

In a preferred development, a satellite-based positioning system is used to determine the position (e.g., a GPS receiver, a Galileo receiver, etc.).

In a preferred development, the position of the train is continuously determined during the entire journey so that the current position is available at all times.

In the event of a disrupted satellite reception, the position determination is replaced from the time of the disruption by a route detection system installed in the train and based on a determination of wheel revolutions.

In a preferred development, the train's predetermined total length is stored in the train's control system.

With this information, it is possible to determine the minimum zone length required for the train for the emergency stop.

In addition, the location of the antenna used for satellite reception on the train is stored in the train's control system.

With this additional information "total length, installation location", it is possible to determine the position of a front and a rear end of the train.

In a preferred development, the information list with the zones, current position of the train, total length of the train, position of the front and rear ends of the train, and/or minimum zone length required for the emergency stop is used to find a suitable location along the route for the emergency stop.

In a preferred development, the installation location or the position of the satellite antenna in the train is calculated using the information stored in the control system about the train composition.

In a fourth step, the distance of the train to the next possible emergency stop is calculated.

Based on the current position of the train and the information stored in the train, the control system calculates the distance from the train to the next possible area for an emergency stop.

In a preferred development, the following information is used for this purpose:

distance from the front end of the train set to the next (preceding) emergency stop zone, distance of the rear end of the train set from one end of an emergency stop prevention zone, which may just be passed through, for the automatically executed emergency stop, the location of the expected standstill of the end of the train with the help of the train parameters (mass, length, brake hundredths), for the automatically executed emergency stop, the location of the expected standstill of the train start (with the help of the train parameters mass, length, braking hundredths, current friction values wheel/rail, weather conditions, etc.).

In a fifth step, braking is automatically initiated or carried out on the train with the appropriate braking parameters in such a way that the nearest emergency stop zone is reached and the complete train comes to a standstill.

In a preferred development, an automatic emergency stop function provided for this purpose continuously compares the current train position with the stored location information of the zones.

When the request for the emergency stop is received, the emergency stop function evaluates whether an emergency stop is allowed to take place at the current time:

If part of the train is currently in an emergency stop prevention zone, the emergency stop function prevents emergency braking to stop the train immediately.

The automatic emergency stop function only initiates emergency braking when and in such a way that the end of the train passes through an emergency stop prevention zone at the optimum time and comes to a standstill behind the emergency stop prevention zone in the emergency stop zone as quickly as possible.

If there is no longer any part of the train in the emergency stop prevention zone, the emergency stop function uses the expected braking distance to calculate whether or not the start of the train will come to a standstill before the next emergency stop prevention zone.

If this is the case, it triggers the emergency braking immediately. If this is not the case, the emergency stop function delays the emergency braking in such a way that the rear end of the train comes to a standstill directly behind the emergency stop prevention zone at the optimum time.

The expected braking distance is continuously calculated by the automatic emergency stop function on the basis of train data (train length, braking hundredths, mass, current wheel/rail friction values, weather conditions, etc.) and the current train speed.

Emergency braking is triggered by transmitting appropriate braking commands to the train's braking and drive equipment.

This is done in a "time-optimized" manner, i.e., the activation of the brakes and their force is selected so that the end of the train comes to a standstill as quickly as possible and outside an emergency stop prevention zone.

In a preferred development, the driver has the option of canceling an automatic emergency stop or manually triggering an emergency stop at any time by using control elements on a driver's console.

In accordance with the invention, the described method according to the invention additionally involves coordination with the operations control center.

This gives the operations control center the option of releasing the automatic emergency stop by transmitting a corresponding command to the train and causing the train to continue its journey—for example, to bring it to a stop at a suitable other location.

With the present invention, a train is automatically brought to a standstill at an optimum point without manual intervention by the driver when an emergency stop is requested.

With the present invention, the information required for the emergency stop is determined without loss of time and is made available to an operations control center, which can then promptly transmit an exact location for the emergency stop to be carried out.

The present invention also enables optional intervention by the train driver and/or on the land side during the execution of the emergency stop.

The present invention increases both the precision and reproducibility of emergency braking.

The present invention reduces reaction times and possibly erroneous human intervention.

The invention is explained in greater detail below with the aid of a drawing.

DETAILED DESCRIPTION OF THE INVENTION

Figure 1:
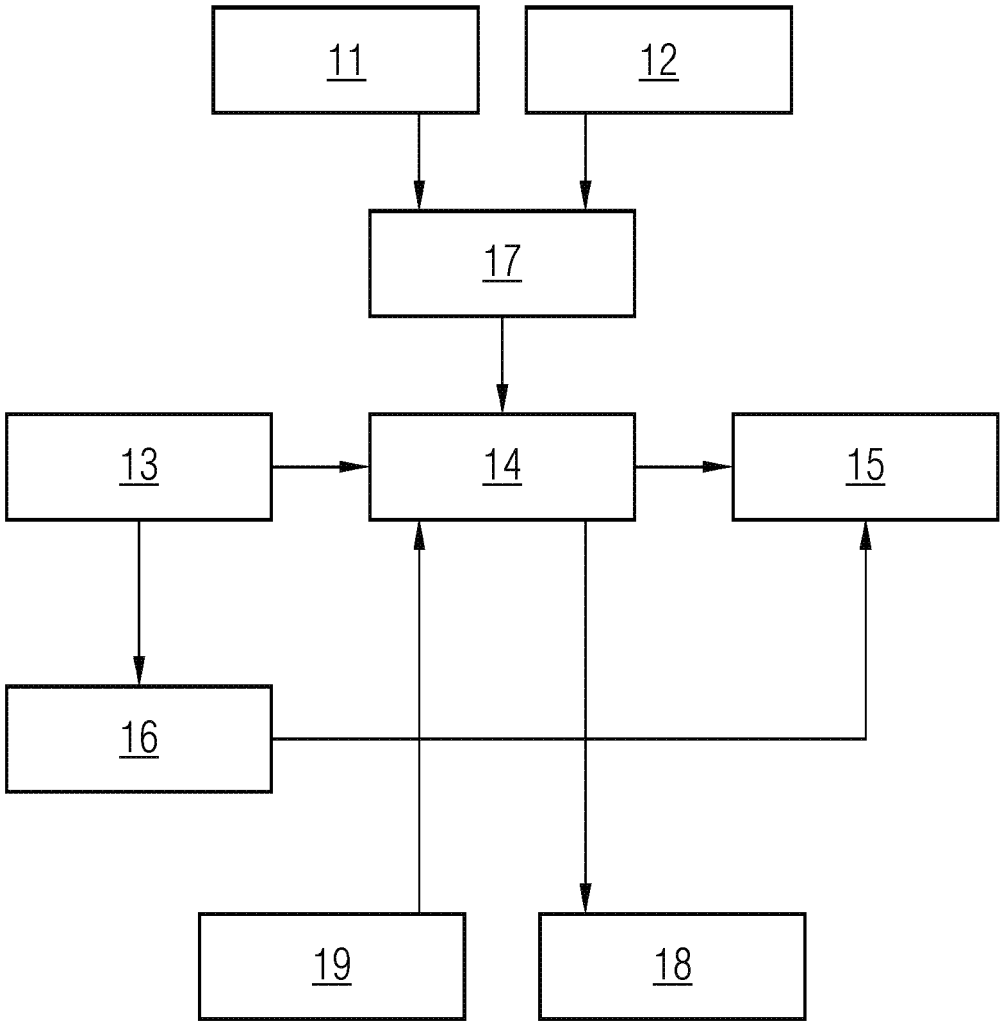
FIG. 1 shows a block diagram of the present invention.

FIG. 1 shows a block diagram of the present invention.

In a block 11, before the train starts its journey, the route it is to travel is analyzed with regard to suitable stopping points or stopping zones that are suitable for stopping the train in the event of an emergency stop. These locations are defined as emergency stop zones.

Alternatively or in addition to this, so-called "emergency stop prevention zones" are defined in which the train is not allowed to stop in the event of an emergency stop.

These zones are made available as a list on board the train for automated use before the start of the journey.

In a block 12, the position of the train is automatically detected or determined. The position is preferably determined by the train and therefore independently of the land side.

In a preferred development, a GPS positioning system is used to determine the position.

The position is continuously determined throughout the train's journey so that the current position is available at all times.

In a block 13, an emergency stop request is made by the train during its journey. This is triggered by a passenger or by an internal train control system.

In a block 14, this request is received, evaluated and processed by an automatic emergency stop function provided for this purpose.

By requesting an emergency stop, a distance of the train to one end of an "emergency stop prevention zone" is calculated in a block 17 on the basis of the position of the train (see block 11) and the zones specified in the list (see block 11) and transmitted to the emergency stop function (see block 14).

The emergency stop request (see block 13) is also communicated to the driver in a block 16. The driver then has the option of "resetting" the emergency stop request or manually postponing the execution of the emergency stop or suppressing it altogether depending on the situation.

For this purpose, the train driver can act on a block 15, which is intended to influence a train brake or a train drive.

The emergency stop function (see block 14) accesses block 15 to perform the emergency stop in order to bring the train to a standstill when the train has reached the end of the emergency stop prevention zone or when the train has reached an emergency stop zone and is completely inside it.

The automatic emergency stop function (see block 14) also notifies an operations control center of the request for an emergency stop. The operations control center is addressed in block 18.

The land-side operations control center is given access to the emergency stop function (see block 14) via block 19.

Figure 2:
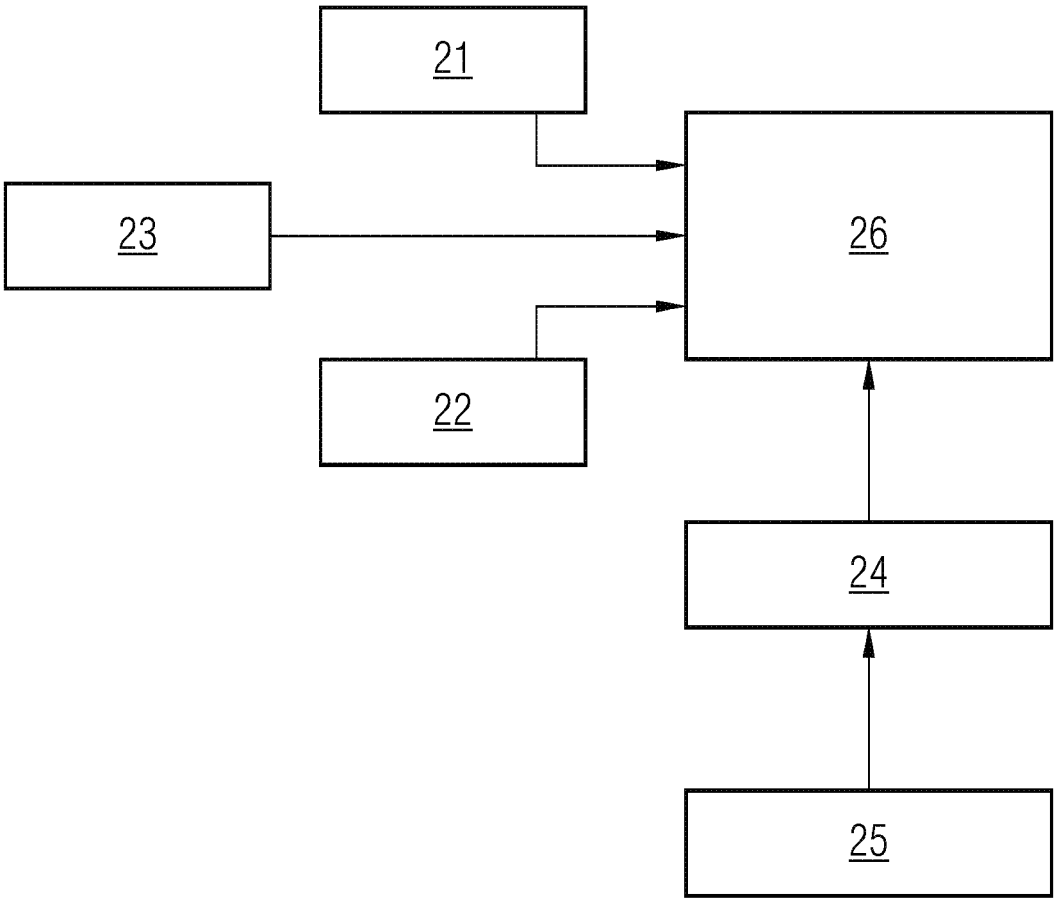
FIG. 2 with reference to FIG. 1 shows a block diagram for position calculation.

With reference to FIG. 1, FIG. 2 shows a block diagram for determining the position of the train.

A train length is stored in a block 23 and is transferred to block 26 for position calculation and is used there.

The position of the train and its ends is calculated in block 26. To do this, the position of a front and rear end of the train is used in block 26 to precisely record the train dimensions.

In block 21, the position of the train is defined or determined automatically. A GPS positioning system is used to determine the position. The position of the train is then transmitted to block 26 and used there.

In block 22, the position of the train is determined with the help of a path detection system in order to safeguard against disrupted satellite reception. The path detection is installed in the train and is based on the determination of wheel revolutions. This position of the train is also transmitted to block 26 and used there.

On the train side, block 25 contains a train sequence or information on the train composition, which is transferred to block 24.

In block 24, an installation location or a position of the satellite antenna in the train is known, so that information from block 25 can be used to calculate the positions of the two ends of the train for block 26.

The invention claimed is:

1. A method for carrying out a requested emergency stop for a train in order to bring the train to a stop at a suitable point on a route traveled by the train, which comprises the steps of:

making available a list on a train side in which zones are defined for the route to be traveled by the train in which the train is allowed and/or is not allowed to stop in an event of the requested emergency stop;

during travel automatically recording and analyzing a request for the emergency stop by the train without an involvement of a driver;

determining automatically, via the train, a position of the train in relation to the route being traveled, independently of trackside equipment;

automatically selecting a suitable zone from the list for the emergency stop to be carried out depending on the position of the train, in which the train can be brought to a standstill after reaching the suitable zone;

automatically notifying a fixed operations control center of the request for the emergency stop; and performing a coordination with the operations control center in order to give the operations control center an option of releasing an automatic emergency stop by transmitting a command to the train in order to cause the train to continue its journey and in order to bring it to a stop at a suitable other location.

2. The method according to claim 1, which further comprises defining the zones with an aid of a geographical map, so that the zones are geographically defined with an aid of coordinates.

3. The method according to claim 1, which further comprises storing the list in a vehicle control system of the train.

4. The method according to claim 1, which further comprises triggering the request for the emergency stop by a passenger or by an internal train control system.

5. The method according to claim 1, which further comprises communicating the request for the emergency stop to a driver of the train to enable the driver to influence the requested emergency stop depending on a situation.

6. The method according to claim 1, which further comprises determining the position of the train with an aid of a satellite-based positioning system provided in the train.

7. The method according to claim 6, which further comprises replacing satellite-based position determination in an event of malfunctions with path detection provided in the train, the path detection is based on a determination of a number of wheel revolutions.

8. The method according to claim 1, which further comprises basing a selection of the suitable zone for the emergency stop on at least one of a following items of information:

distance of the train to the suitable zone;

current position of the train;

total length of the train;

position of one front and one rear end of the train;

minimum zone length required for the emergency stop; and/or position of a satellite antenna in the train.

9. The method according to claim 1, wherein after reaching the suitable zone for the emergency stop on the train, initiating and carrying out braking automatically such that the train comes to a standstill in the suitable zone for the emergency stop and the train is completely stationary therein.

10. The method according to claim 9, which further comprises carrying out the braking in such a way that the standstill within the suitable zone for the emergency stop takes place with an ideally short time delay, taking into account a braking capability of the train.

* * * * *